US008656729B2

(12) United States Patent
Matsuoka et al.

(10) Patent No.: US 8,656,729 B2
(45) Date of Patent: Feb. 25, 2014

(54) AIR CONDITIONING SYSTEM WITH DEFROSTING OPERATION

(75) Inventors: Hiromune Matsuoka, Osaka (JP); Toshiyuki Kurihara, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 1016 days.

(21) Appl. No.: 12/307,241

(22) PCT Filed: Jul. 5, 2007

(86) PCT No.: PCT/JP2007/063457
§ 371 (c)(1),
(2), (4) Date: Dec. 31, 2008

(87) PCT Pub. No.: WO2008/004621
PCT Pub. Date: Jan. 10, 2008

(65) Prior Publication Data

US 2009/0282854 A1 Nov. 19, 2009

(30) Foreign Application Priority Data

Jul. 6, 2006 (JP) ..... 2006-186738

(51) Int. Cl.
*F25B 13/00* (2006.01)

(52) U.S. Cl.
USPC ..... 62/324.1; 62/526

(58) Field of Classification Search
USPC ..... 62/324.1, 526, 324.5, 81, 278, 198, 62/264, DIG. 1
See application file for complete search history.

(56) References Cited

U.S. PATENT DOCUMENTS

| | | | | | |
|---|---|---|---|---|---|
| 2,072,643 | A * | 3/1937 | Mays | 62/248 |
| 4,697,430 | A * | 10/1987 | Toyoda et al. | 62/209 |
| 4,938,032 | A * | 7/1990 | Mudford | 62/160 |
| 4,939,910 | A * | 7/1990 | Umezu et al. | 62/160 |
| 5,086,626 | A * | 2/1992 | Iida | 62/184 |
| 6,378,318 | B1 | 4/2002 | Jin | |
| 6,775,998 | B2 * | 8/2004 | Yuasa et al. | 62/197 |
| 6,931,880 | B2 * | 8/2005 | Aflekt et al. | 62/277 |
| 7,089,754 | B2 * | 8/2006 | Chin et al. | 62/324.1 |
| 2006/0168997 | A1 | 8/2006 | Imai et al. | |
| 2007/0137230 | A1 * | 6/2007 | Bae et al. | 62/198 |
| 2007/0157660 | A1 * | 7/2007 | Lee et al. | 62/498 |

FOREIGN PATENT DOCUMENTS

| | | |
|---|---|---|
| JP | 46-36051 | 12/1971 |
| JP | 62-69071 A | 3/1987 |
| JP | 63-210575 A | 9/1988 |
| JP | 64-28449 A | 1/1989 |
| JP | 7-18935 A | 1/1995 |

(Continued)

*Primary Examiner* — Mohammad M Ali
(74) *Attorney, Agent, or Firm* — Birch, Stewart, Kolasch & Birch, LLP

(57) ABSTRACT

An air conditioning system includes a refrigerant circuit (20) in which a compressor (21), an indoor radiant panel (23), a first expansion valve (24), a room air heat exchanger (25), a second expansion valve (26) and an outdoor air heat exchanger (27) are connected in this order and which operates in a refrigeration cycle by reversibly circulating refrigerant therethrough. During a defrosting operation, the first expansion valve (24) is controlled to reduce the refrigerant pressure so that in a cooling cycle the refrigerant releases heat in the outdoor air heat exchanger (27) and the room air heat exchanger (25) and evaporates in the indoor radiant panel (23). Thus, the air conditioning system concurrently provides the defrosting of the outdoor air heat exchanger (27) and the room heating of the room air heat exchanger (25).

6 Claims, 7 Drawing Sheets

(56) References Cited

FOREIGN PATENT DOCUMENTS

| | | | |
|---|---|---|---|
| JP | 7-127994 | A | 5/1995 |
| JP | 2005-16919 | A | 1/2005 |
| JP | 2006-162173 | A | 6/2006 |
| JP | 2006-207974 | A | 8/2006 |
| KR | 0357988 | | 10/2002 |

* cited by examiner

AIR CONDITIONING SYSTEM WITH DEFROSTING OPERATION

TECHNICAL FIELD

This invention relates to air conditioning systems and particularly relates to improvements in comfort during their defrosting operation.

BACKGROUND ART

Air conditioning systems are conventionally known that include a radiant panel and an indoor heat exchanger and provide room heating with radiant heat and warm air. For example, an air conditioning system disclosed in Patent Document 1 includes a refrigerant circuit in which a compressor, an outdoor heat exchanger, an expansion valve, an indoor heat exchanger and a radiant panel are connected in this order. The refrigerant circuit is configured to operate in a refrigeration cycle by reversibly circulating refrigerant therethrough.

According to this air conditioning system, in a heating operation (heating cycle), refrigerant discharged from the compressor flows through the radiant panel and the indoor heat exchanger in this order to condense, whereby warm air from the indoor heat exchanger and radiant heat from the radiant panel are supplied to the room. On the other hand, in a cooling operation (cooling cycle), refrigerant having condensed in the outdoor heat exchanger evaporates in the indoor heat exchanger, whereby cold air from the indoor heat exchanger is supplied to the room. The refrigerant having evaporated in the indoor heat exchanger bypasses the radiant panel and then returns to the compressor.

Patent Document 1: Published Japanese Utility Model Application No. H07-18935

DISCLOSURE OF THE INVENTION

Problem to be Solved by the Invention

The above-stated conventional air conditioning system, however, has a problem that in defrosting the outdoor heat exchanger in a cooling cycle room heating using the indoor heat exchanger must be stopped. This results in impairment of comfort in the room during the defrosting operation.

Specifically, during the defrosting operation, the refrigerant discharged from the compressor flows through the outdoor heat exchanger to condense therein, whereby the outdoor heat exchanger is defrosted. The refrigerant having condensed is reduced in pressure by the expansion valve and then evaporated in the indoor heat exchanger and the radiant panel. Since, thus, the indoor heat exchanger located downstream of the expansion valve needs to function as an evaporator, room heating using the indoor heat exchanger cannot be carried out.

The present invention has been made in view of the foregoing point and, therefore, an object thereof is that when an air conditioning system including a radiant panel and an indoor heat exchanger performs a defrosting operation in a cooling cycle, it can concurrently provide room heating to prevent impairment of comfort in the room.

Means to Solve the Problem

A first aspect of the invention is an air conditioning system including a refrigerant circuit (20) in which a compressor (21), an indoor radiant heat exchanger (23), a first pressure reduction mechanism (24), a room air heat exchanger (25), a second pressure reduction mechanism (26) and an outdoor heat exchanger (27) are connected in this order and which operates in a vapor compression refrigeration cycle by reversibly circulating refrigerant therethrough. Furthermore, in the above aspect of the invention, the first pressure reduction mechanism (24) is controlled to reduce the refrigerant pressure so that in a cooling cycle of the refrigerant circuit (20) the refrigerant releases heat in the outdoor heat exchanger (27) and the room air heat exchanger (25) and takes heat in the indoor radiant heat exchanger (23) to evaporate.

According to the above aspect of the invention, during a heating operation, the refrigerant circulates through the refrigerant circuit (20) in a heating cycle in which the refrigerant discharged from the compressor (21) releases heat to air in the room air heat exchanger (25) and then takes heat in the outdoor heat exchanger (27) to evaporate. On the other hand, during a cooling operation, the refrigerant circulates through the refrigerant circuit (20) in a cooling cycle in which the refrigerant discharged from the compressor (21) releases heat in the outdoor heat exchanger (27) and then takes heat from air in the room air heat exchanger (25) to evaporate.

Furthermore, according to the above aspect of the invention, in defrosting the outdoor heat exchanger (27), the refrigerant discharged from the compressor (21) releases heat in the outdoor heat exchanger (27) and thereby defrosts the outdoor heat exchanger (27). The refrigerant having released heat releases remaining heat to air in the room air heat exchanger (25) and thereby heats the room. Subsequently, the refrigerant after the heat release is reduced in pressure to a predetermined pressure by the first pressure reduction mechanism (24) and then flows into the indoor radiant heat exchanger (23). The refrigerant takes heat from the indoor radiant heat exchanger (23) to evaporate. The refrigerant having evaporated returns to the compressor (21). In other words, during the defrosting operation in the above aspect of the invention, the refrigerant is evaporated not in the room air heat exchanger (25) but using heat of the indoor radiant heat exchanger (23) itself. Thus, the air conditioning system can provide room heating while defrosting the outdoor heat exchanger (27).

A second aspect of the invention is the air conditioning system according to the first aspect of the invention, wherein the second pressure reduction mechanism (26) is controlled to reduce the refrigerant pressure so that in a heating cycle of the refrigerant circuit (20) the refrigerant releases heat in the indoor radiant heat exchanger (23) and the room air heat exchanger (25) and takes heat in the outdoor heat exchanger (27) to evaporate.

In the above aspect of the invention, during the heating operation, the refrigerant discharged from the compressor (21) releases heat in the indoor radiant heat exchanger (23) to reduce its temperature, then further releases heat to air in the room air heat exchanger (25) and is thereby cooled. At the indoor radiant heat exchanger (23), an amount of heat taking from high-temperature refrigerant is supplied in the form of radiant heat to the room. At the room air heat exchanger (25), heated air is supplied in the form of warm air to the room. The room is heated by the radiant heat and the warm air.

A third aspect of the invention is the air conditioning system according to the first or second aspect of the invention, wherein the second pressure reduction mechanism (26) is controlled to reduce the refrigerant pressure so that in the cooling cycle of the refrigerant circuit (20) the refrigerant releases heat in the outdoor heat exchanger (27) and takes heat in the room air heat exchanger (25) and the indoor radiant heat exchanger (23) to evaporate.

In the above aspect of the invention, during the cooling operation, the refrigerant reduced in pressure to the predetermined pressure by the second pressure reduction mechanism (26) takes heat from air in the room air heat exchanger (25) and then further takes heat from the indoor radiant heat exchanger (23) to evaporate. At the room air heat exchanger (25), cooled air is supplied in the form of cold air to the room. On the other hand, the indoor radiant heat exchanger (23) is cooled by the action of refrigerant taking heat, whereby its surrounding air is cooled. Thus, the room air is radiatively cooled. Therefore, the room is cooled by the cold air and the radiative cooling.

A fourth aspect of the invention is the air conditioning system according to the third aspect of the invention, wherein the refrigerant circuit (20) includes a bypass passage (28) through which the refrigerant flows to bypass the indoor radiant heat exchanger (23) and the first pressure reduction mechanism (24), and the bypass passage (28) is provided with a shut-off valve (29).

In the above aspect of the invention, for example, during the cooling operation, the shut-off valve (29) is selected to an open position, whereby the refrigerant having evaporated by taking heat from air in the room air heat exchanger (25) does not flow through the indoor radiant heat exchanger (23) but flows through the bypass passage (28). Thus, the room is cooled only by cold air from the room air heat exchanger (25).

A fifth aspect of the invention is the air conditioning system according to the first or second aspect of the invention, wherein the indoor radiant heat exchanger (23) and the room air heat exchanger (25) are provided in a single indoor unit (11). Furthermore, the indoor radiant heat exchanger (23) is provided on a casing (12) for the indoor unit (11) so that the radiant surface thereof emitting radiant heat faces a room, and the room air heat exchanger (25) is contained in the casing (12) for the indoor unit (11).

In the above aspect of the invention, the installation space for the indoor radiant heat exchanger (23) and the room air heat exchanger (25) can be reduced.

A sixth aspect of the invention is the air conditioning system according to the first aspect of the invention, wherein the second pressure reduction mechanism (26) is configured to avoid reduction of the refrigerant pressure so that in the cooling cycle of the refrigerant circuit (20) the refrigerant releases heat in the outdoor heat exchanger (27) and the room air heat exchanger (25) and takes heat in the indoor radiant heat exchanger (23) to evaporate.

In the above aspect of the invention, the refrigerant having released heat in the outdoor heat exchanger (27) is not reduced in pressure at all in the second pressure reduction mechanism (26). Therefore, the refrigerant flows into the room air heat exchanger (25) without reducing its temperature, which enhances the heating capacity of the room air heat exchanger (25).

A seventh aspect of the invention is the air conditioning system according to any one of the first to third aspects of the invention, wherein the refrigerant is carbon dioxide.

In the above aspect of the invention, the refrigerant, which is carbon dioxide, is compressed to its supercritical pressure by the compressor (21). The discharged refrigerant at supercritical pressure has a wider high-temperature region than common refrigerant in a so-called subcritical state. Therefore, for example, during the defrosting operation, the amount of heat released from the refrigerant in the outdoor heat exchanger (27) and the room air heat exchanger (25) increases. Thus, the air conditioning system enhances both the defrosting capacity and the heating capacity. On the other hand, during the heating operation, the amount of heat released from the refrigerant in the indoor radiant heat exchanger (23) and the room air heat exchanger (25) increases. Therefore, the air conditioning system enhances the heating capacity due to radiant heat and warm air.

EFFECTS OF THE INVENTION

According to the present invention, the first pressure reduction mechanism (24) is controlled so that the refrigerant releases heat in both the outdoor heat exchanger (27) and the room air heat exchanger (25) and evaporates in the indoor radiant heat exchanger (23). Thus, the air conditioning system can provide room heating with warm air from the room air heat exchanger (25) while defrosting the outdoor heat exchanger (27). Therefore, there is no need to stop the room heating even during the defrosting operation, which prevents the comfort in the room from being impaired.

According to the second aspect of the invention, the second pressure reduction mechanism (26) is controlled so that the refrigerant evaporates in both the indoor radiant heat exchanger (23) and the room air heat exchanger (25). Thus, the room can be cooled not only by cold air from the room air heat exchanger (25) but also by radiative cooling of the indoor radiant heat exchanger (23). Therefore, the amount of cold air supplied can be reduced by the amount of heat due to the radiative cooling, which reduces the sense of draft of the user and thereby improves the comfort.

According to the third aspect of the invention, the second pressure reduction mechanism (26) is controlled so that the refrigerant releases heat in both the indoor radiant heat exchanger (23) and the room air heat exchanger (25). Thus, the room can be heated not only by warm air from the room air heat exchanger (25) but also by radiant heat from the indoor radiant heat exchanger (23). Therefore, the amount of warm air supplied can be reduced by the amount of radiant heat, which reduces the sense of draft of the user.

According to the fourth aspect of the invention, since the bypass passage (28) is provided through which the refrigerant flows to bypass the indoor radiant heat exchanger (23) and the first pressure reduction mechanism (24), radiative cooling can be avoided when the cooling load is small. Furthermore, under conditions that dew would otherwise form on the radiant surface of the indoor radiant heat exchanger (23), dew formation can be prevented by avoiding the radiative cooling.

According to the fifth aspect of the invention, since the indoor radiant heat exchanger (23) and the room air heat exchanger (25) are provided in a single indoor unit (11), the installation space for the air conditioning system can be reduced.

According to the seventh aspect of the invention, since carbon dioxide is used as the refrigerant, the refrigerant can have a wide high-temperature region by compressing the refrigerant to its supercritical pressure. Therefore, during the defrosting operation, a sufficient amount of heat released from the refrigerant and needed for the defrosting of the outdoor air heat exchanger (27) and the room heating of the room air heat exchanger (25) can be obtained. Thus, the air conditioning system can surely provide defrosting and room heating. Since during the heating operation the radiant heat of the indoor radiant panel (23) can be increased, the amount of air from the room air heat exchanger (25) can be reduced accordingly, thereby reducing the sense of draft. As a result, the comfort in the room can be improved.

LIST OF REFERENCE NUMERALS

Figure 1:
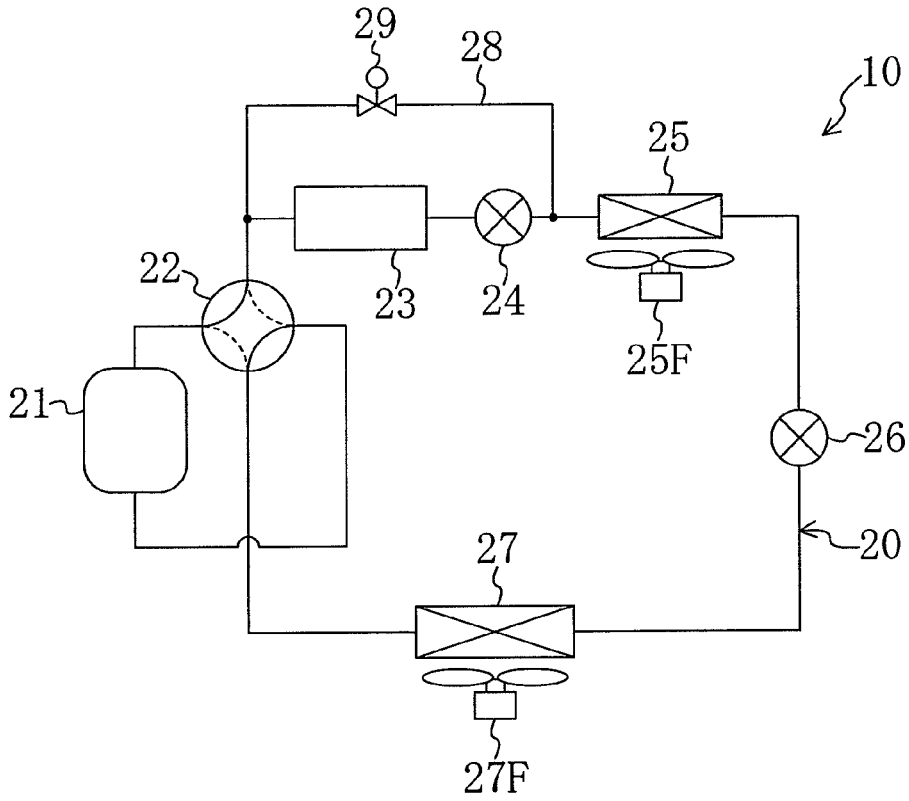
FIG. 1 is a refrigerant circuit diagram showing the overall configuration of an air conditioning system.

10 air conditioning system
11 indoor unit
12 casing
20 refrigerant circuit
21 compressor
23 indoor radiant panel (indoor radiant heat exchanger)
24 first expansion valve (first pressure reduction mechanism)
25 room air heat exchanger
26 second expansion valve (second pressure reduction mechanism)
27 outdoor air heat exchanger (outdoor heat exchanger)
28 bypass passage
29 solenoid valve (shut-off valve)

BEST MODE FOR CARRYING OUT THE INVENTION

Embodiments of the present invention will be described below in detail with reference to the drawings.

Figure 2B:
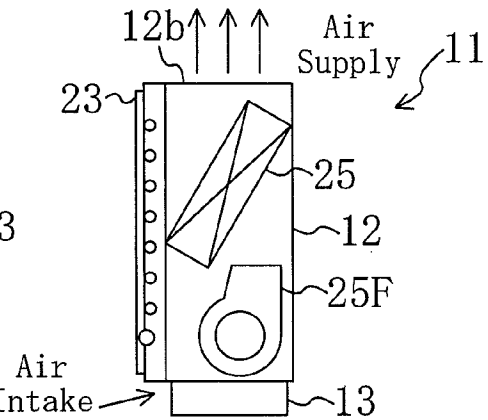
FIG. 2 shows the configuration of an indoor unit, wherein 2A is a front view and 2B is a cross-sectional view as viewed from the right.
Figure 2A:
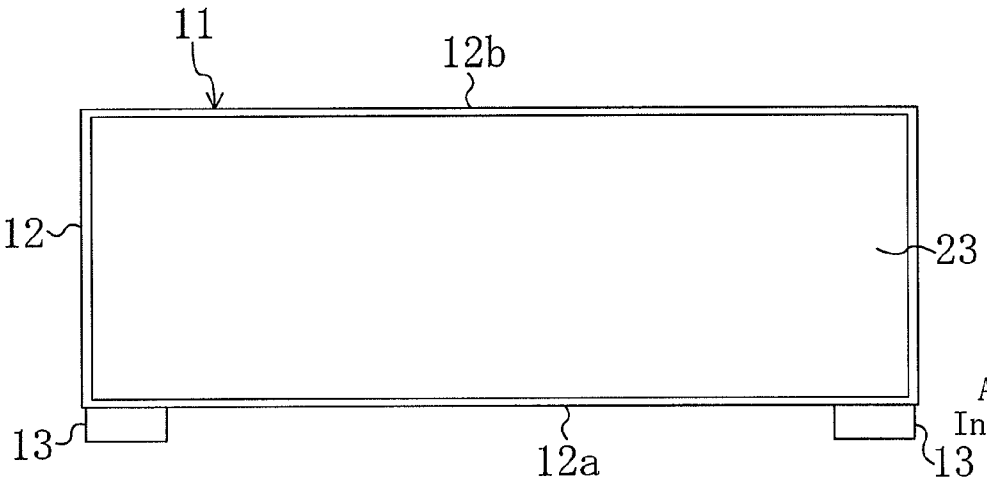
Figure 3:
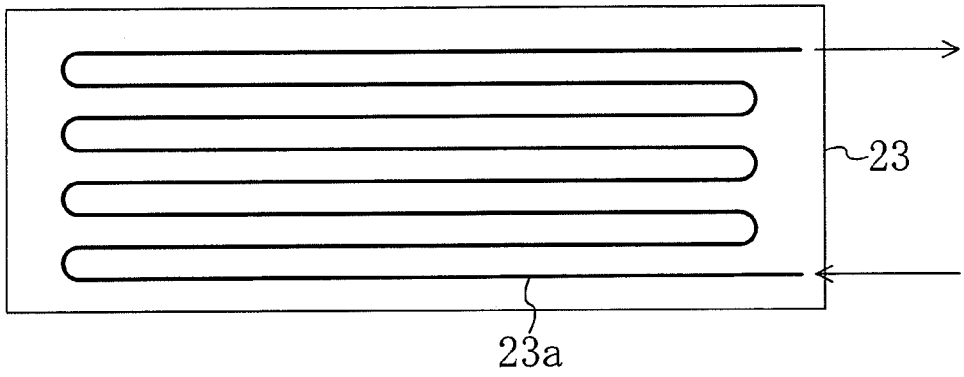
FIG. 3 is a plan view showing the interior of an indoor radiant panel.

As shown in FIGS. 1 to 3, an air conditioning system (10) according to this embodiment is configured to provide room cooling and room heating. The air conditioning system (10) includes a refrigerant circuit (20).

The refrigerant circuit (20) includes a compressor (21), an indoor radiant panel (23), a first expansion valve (24), a room air heat exchanger (25), a second expansion valve (26) and an outdoor air heat exchanger (27) that are connected therein via pipes in this order, thereby constituting a closed circuit. The refrigerant circuit (20) further includes a four-way selector valve (22) that is connected via pipes between the compressor (21) and the indoor radiant panel (23) and between the compressor (21) and the outdoor air heat exchanger (27). Furthermore, the refrigerant circuit (20) is charged with carbon dioxide ($CO_2$) as refrigerant and configured to operate in a vapor compression refrigeration cycle by circulating the refrigerant therethrough.

The refrigerant circuit (20) can reverse the direction of circulation of the refrigerant by changing the position of the four-way selector valve (22). In other words, changeover is made between a circulation of the refrigerant flowing in a cooling cycle and a circulation of the refrigerant flowing in a heating cycle. For example, when the four-way selector valve (22) is changed to the position shown in the solid lines in FIG. 1, the refrigerant circulates counterclockwise in a heating cycle. On the other hand, when the four-way selector valve (22) is changed to the position shown in the broken lines in FIG. 1, the refrigerant circulates clockwise in a cooling cycle.

The compressor (21) is a displacement compressor, such as a rotary compressor or a scroll compressor. The compressor (21) is configured to compress sucked refrigerant (carbon dioxide) to its supercritical pressure. Thus, in the refrigerant circuit (20), its high-side pressure exceeds the critical pressure of the refrigerant.

The room air heat exchanger (25) and the outdoor air heat exchanger (27) are each composed of a cross-fin-and-tube heat exchanger in which refrigerant exchanges heat with air. Disposed close to the room air heat exchanger (25) and the outdoor air heat exchanger (27) are an indoor fan (25F) and an outdoor fan (27F), respectively. At the room air heat exchanger (25), air heated or cooled by heat exchange with the refrigerant is supplied to the room, thereby heating or cooling the room. The outdoor air heat exchanger (27) constitutes an outdoor heat exchanger in the present invention.

The indoor radiant panel (23), during the heating operation, takes heat from the refrigerant and supplies radiant heat to the room. In other words, the indoor radiant panel (23) provides radiant heating. On the other hand, during the cooling operation, the indoor radiant panel (23) is cooled by the action of the refrigerant taking heat, whereby its surrounding air is cooled. In other words, the indoor radiant panel (23) provides radiant cooling. The indoor radiant panel (23) constitutes an indoor radiant heat exchanger in the present invention.

Each of the first expansion valve (24) and the second expansion valve (26) constitutes an expansion mechanism for the refrigerant. The first expansion valve (24) and the second expansion valve (26) are configured to control the refrigerant to reduce the refrigerant pressure by controlling their openings and constitute a first pressure reduction mechanism and a second pressure reduction mechanism, respectively, in the present invention.

Furthermore, the refrigerant circuit (20) includes a bypass passage (28) through which the refrigerant bypasses the indoor radiant panel (23) and the first expansion valve (24). The bypass passage (28) is provided with a solenoid valve (29) serving as a shut-off valve.

The indoor radiant panel (23), the first expansion valve (24), the solenoid valve (29), the room air heat exchanger (25) and the indoor fan (25F) constitute a single indoor unit (11) as shown in FIGS. 2A and 2B. The indoor unit (11) is configured as a so-called floor-mounted unit. Note that in FIGS. 2A and 2B the first expansion valve (24) and the solenoid valve (29) are not given.

The indoor unit (11) includes a casing (12) formed in a horizontally long, rectangular shape. The casing (12) has two legs (13) provided at both ends of its bottom. The casing (12) also has an air inlet (12*a*) formed in the center of the bottom surface and an air outlet (12*b*) formed in the top surface to extend in the longitudinal direction. Furthermore, the casing (12) has the indoor radiant panel (23) fitted into the front surface thereof over substantially the entire area. The casing (12) contains the room air heat exchanger (25) and the indoor fan (25F). The room air heat exchanger (25) is disposed towards the back surface of the indoor radiant panel (23) and its top is inclined towards the back of the casing (12). On the other hand, the indoor fan (25F) is disposed towards the back surface of the indoor radiant panel (23) and below the room air heat exchanger (25). The indoor radiant panel (23) has a heat exchanger tube (23*a*) provided therein as shown in FIG. 3. The heat exchanger tube (23*a*) is configured to allow refrigerant to flow therethrough and planarly disposed over the entire panel. The refrigerant releases heat through the heat exchanger tube (23*a*) to the panel body or takes heat through the heat exchanger tube (23*a*) from the panel body. Both ends of the heat exchanger tube (23*a*) are connected via refrigerant pipes to the first expansion valve (24) and the four-way selector valve (22).

The air conditioning system (10) according to this embodiment provides a defrosting operation for defrosting the outdoor air heat exchanger (27). The defrosting operation is implemented by circulating the refrigerant in a cooling cycle. In the defrosting operation, as a feature of the present invention, the second expansion valve (26) is set to a fully-open position and the first expansion valve (24) is controlled to reduce the refrigerant pressure so that the refrigerant releases heat in the outdoor air heat exchanger (27) and the room air heat exchanger (25) and takes heat in the indoor radiant heat exchanger (23) to evaporate. Thus, the outdoor air heat exchanger (27) is defrosted by heat release of the refrigerant and the room air heat exchanger (25) heats air by heat release of the refrigerant to heat the room.

—Operational Behavior—

Next, a description is given of the operational behavior of the air conditioning system (10) with reference to FIGS. 4 to 8. The air conditioning system (10) is configured to be switchable among a heating operation, a cooling operation and a defrosting operation.

<Heating Operation>

Figure 4:
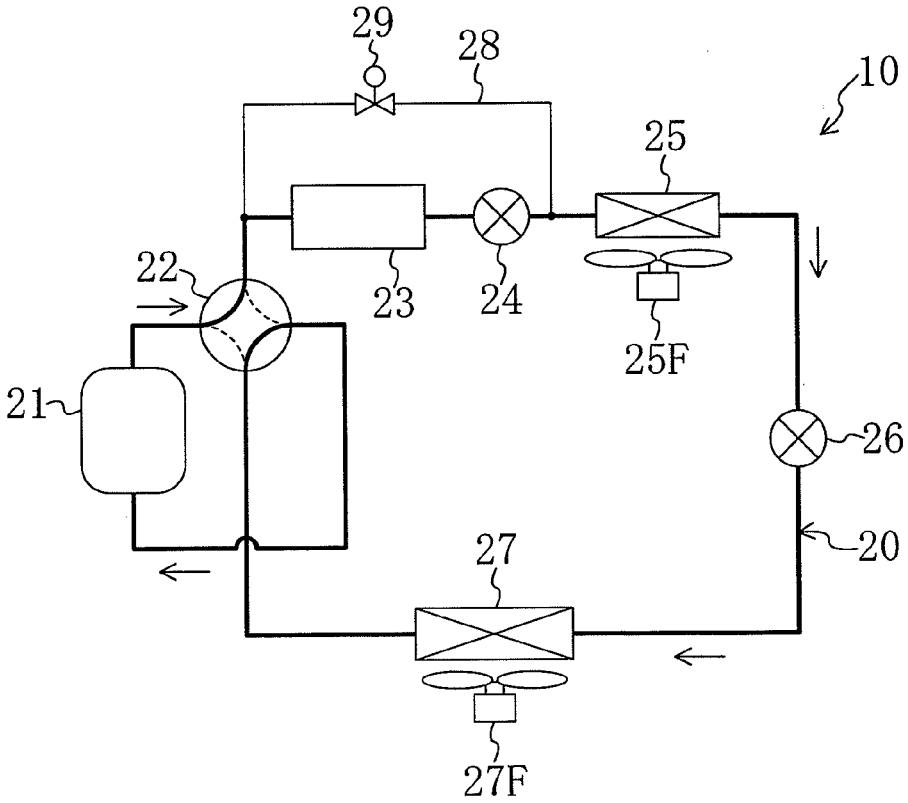
FIG. 4 is a refrigerant circuit diagram showing the behavior of the air conditioning system during a heating operation.

The heating operation is an operation for heating a room with radiant heat from the indoor radiant panel (23) and warm air from the room air heat exchanger (25). As shown in FIG. 4, during the heating operation, the position of the four-way selector valve (22) is selected so that the refrigerant circulates in a heating cycle. Furthermore, the solenoid valve (29) is selected to a closed position, the first expansion valve (24) is set to an open position and the second expansion valve (26) is set to a predetermined opening.

When the compressor (21) is driven under the above conditions, the refrigerant is compressed by the compressor (21), thereby discharged therefrom in the form of high-temperature refrigerant having a supercritical pressure and then flows into the indoor radiant panel (23). At the indoor radiant panel (23), an amount of heat released from the high-temperature refrigerant is supplied in the form of radiant heat to the room. During the heat supply, since the refrigerant is at supercritical pressure, its temperature decreases without condensation even if it releases heat. The refrigerant cooled by the indoor radiant panel (23) passes through the first expansion valve (24) and then flows into the room air heat exchanger (25).

At the room air heat exchanger (25), the refrigerant releases heat to room air taken therein by the indoor fan (25F) and the heated room air is supplied in the form of warm air to the room. During the air supply, since the refrigerant is at supercritical pressure, like the above, its temperature decreases without condensation even if it releases heat. The low-temperature refrigerant obtained by cooling in the room air heat exchanger (25) is reduced to a predetermined pressure by the second expansion valve (26). The refrigerant reduced in pressure flows into the outdoor air heat exchanger (27) and takes heat from outdoor air taken therein by the outdoor fan (27F) to evaporate. The refrigerant having evaporated is compressed again by the compressor (21). The refrigerant repeats this circulation. In this manner, the room is heated by radiant heat from the indoor radiant panel (23) and warm air from the room air heat exchanger (25).

Figure 5:
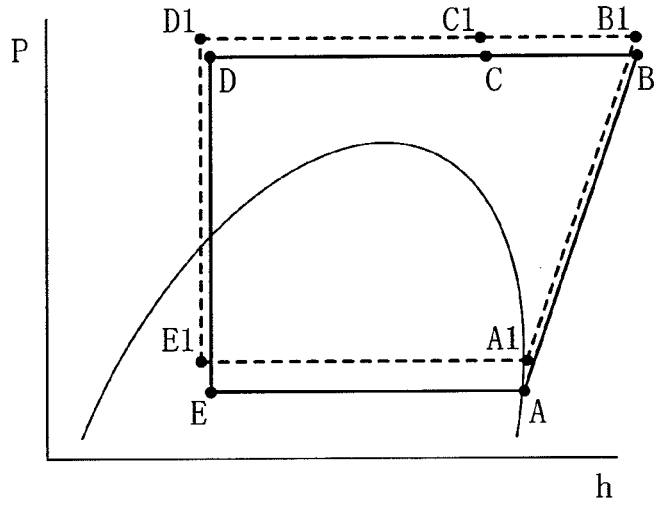
FIG. 5 is a Mollier diagram showing the states of refrigerant during the heating operation and a defrosting operation.

Now, a description is given of the state of refrigerant in the above-stated refrigeration cycle (supercritical cycle) during the heating operation with reference to the Mollier diagram shown in the solid lines in FIG. 5. The state of refrigerant repeatedly changes in order from Point A to Point B, then to Point C, then to Point D, then to Point E and then back to Point A.

Specifically, the refrigerant sucked into the compressor (21) to reach Point A is compressed to Point B by the compressor (21) to be high-temperature refrigerant at supercritical pressure. The refrigerant having reached Point B releases heat in the indoor radiant panel (23) to reduce its temperature and thereby reach Point C. Then, the refrigerant further releases heat in the room air heat exchanger (25) to further reduce its temperature and thereby reach Point D. The refrigerant having reached Point D is reduced in pressure to Point E by the second expansion valve (26). The refrigerant having reached Point E evaporates in the outdoor air heat exchanger (27) to reach Point A and is then sucked into the compressor (21) again.

As seem from the above, unlike a subcritical cycle, the supercritical cycle has no condensation zone and, therefore, has a wide high-temperature region. Therefore, the amount of heat released from the refrigerant in the indoor radiant panel (23) is high, which provides high-temperature radiant heat. As a result, the air conditioning system enhances the heating capacity due to radiant heat. In addition, since the heating capacity due to radiant heat from the indoor radiant panel (23) is high, the necessary heating capacity due to warm air from the room air heat exchanger (25) can be reduced. As a result, the necessary amount of air supply from the room air heat exchanger (25) can be reduced, thereby reducing the sense of draft due to warm air.

<Cooling Operation>

The cooling operation is an operation for cooling a room by radiative cooling of the indoor radiant panel (23) and with cold air from the room air heat exchanger (25).

Figure 6:
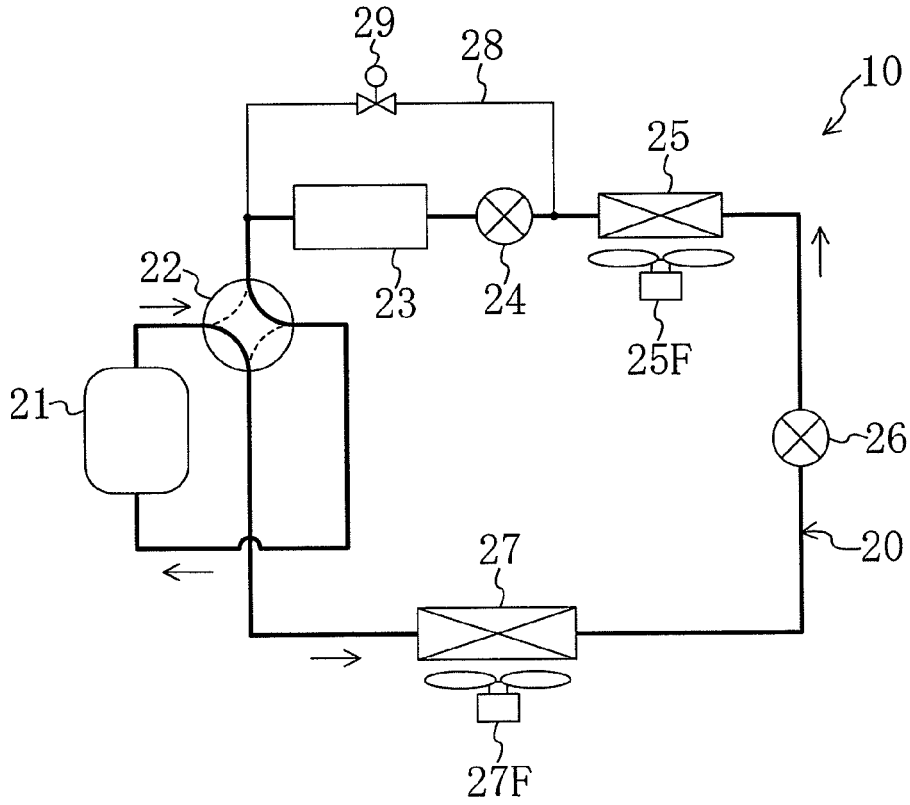
FIG. 6 is a refrigerant circuit diagram showing the behavior of the air conditioning system during a cooling operation and the defrosting operation.

As shown in FIG. 6, during the cooling operation, the position of the four-way selector valve (22) is selected so that the refrigerant circulates in a cooling cycle. Furthermore, the solenoid valve (29) is selected to a closed position, the first expansion valve (24) is set to an open position and the second expansion valve (26) is set to a predetermined opening.

When the compressor (21) is driven under the above conditions, the refrigerant is compressed by the compressor (21), thereby discharged therefrom in the form of high-temperature refrigerant having a supercritical pressure and then flows into the outdoor air heat exchanger (27). At the outdoor air heat exchanger (27), the high-temperature refrigerant releases heat to outdoor air. During the heat release, since the refrigerant is at supercritical pressure, its temperature decreases without condensation even if it releases heat. The refrigerant is reduced to a predetermined pressure by the second expansion valve (26) and then flows into the room air heat exchanger (25).

At the room air heat exchanger (25), the refrigerant takes heat from room air to evaporate and the cooled room air is supplied in the form of cold air to the room. Next, the refrigerant takes heat from the indoor radiant panel (23) into superheated vapor. Thus, the indoor radiant panel (23) is cooled to radiatively cool the surrounding room air. The refrigerant having evaporated is compressed again by the compressor (21). The refrigerant repeats this circulation. In this manner, the room is cooled by radiative cooling of the indoor radiant panel (23) and cold air from the room air heat exchanger (25).

Figure 7:
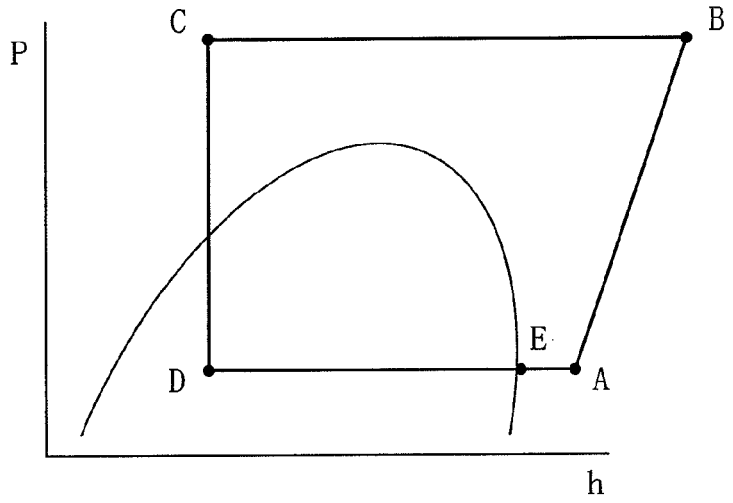
FIG. 7 is a Mollier diagram showing the state of refrigerant during the cooling operation.

Now, a description is given of the state of refrigerant in the above-stated refrigeration cycle (supercritical cycle) during the cooling operation with reference to the Mollier diagram shown in FIG. 7. The state of refrigerant repeatedly changes in order from Point A to Point B, then to Point C, then to Point D, then to Point E and then back to Point A.

Specifically, the refrigerant sucked into the compressor (21) to reach Point A is compressed to Point B by the compressor (21) to be high-temperature refrigerant at supercritical pressure. The refrigerant having reached Point B releases heat in the outdoor air heat exchanger (27) to reduce its temperature and thereby reach Point C. The refrigerant having reached Point C is reduced in pressure to Point D by the second expansion valve (26). The refrigerant having reached Point D evaporates in the room air heat exchanger (25) and thereby reaches Point E. The refrigerant having reached Point E is superheated by taking heat from the indoor radiant panel (23) to reach Point A and is then sucked into the compressor (21) again.

Figure 8:
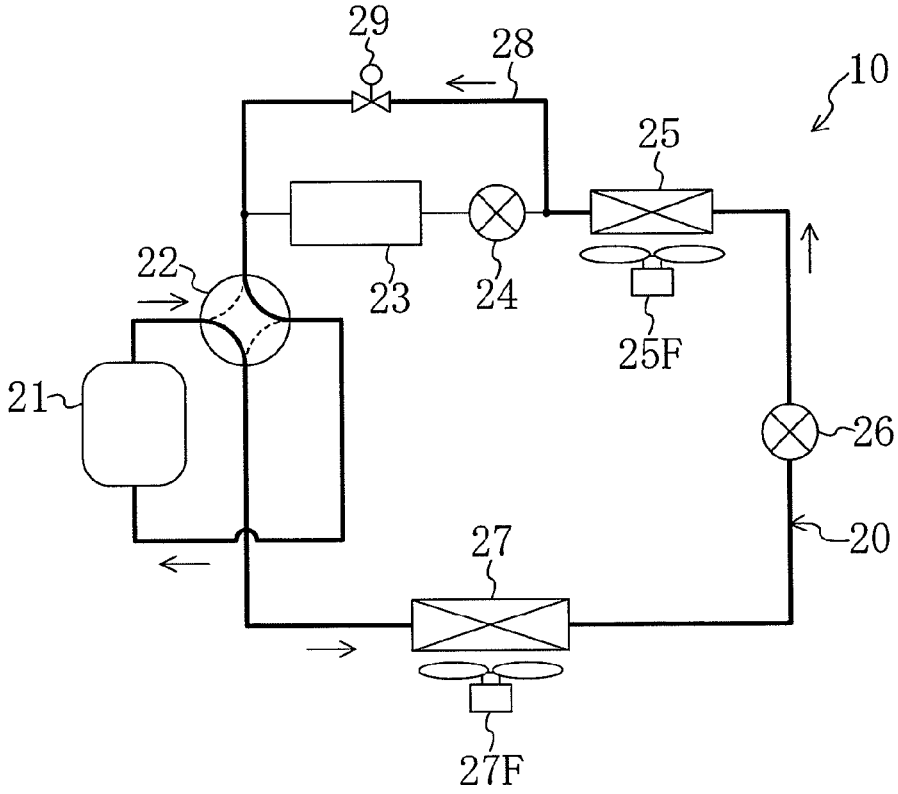
FIG. 8 is a refrigerant circuit diagram showing the behavior of the air conditioning system during the cooling operation.

In the cooling operation, as shown in FIG. 8, the refrigerant may flow through the bypass passage (28). Specifically, in this case, the first expansion valve (24) is set to a closed position and the solenoid valve (29) is selected to an open position. Thus, the refrigerant having evaporated in the room air heat exchanger (25) bypasses the first expansion valve (24) and the indoor radiant panel (23) and returns to the compressor (21). In this manner, when the cooling capacity is not required so much, the radiative cooling of the indoor radiant panel (23) can be avoided. Furthermore, under conditions that dew would otherwise form on the radiant surface of the indoor radiant panel (23), dew formation can be prevented by performing the above operation.

<Defrosting Operation>

The defrosting operation is an operation for concurrently providing the defrosting of the outdoor air heat exchanger (27) and room heating with warm air from the room air heat exchanger (25).

During the defrosting operation, the position of the four-way selector valve (22) is selected so that the refrigerant circulates in a cooling cycle. Furthermore, the solenoid valve (29) is selected to a closed position, the first expansion valve (24) is set to a predetermined opening and the second expansion valve (26) is set to a fully-open position. The refrigerant flow is the same as in the above-stated cooling operation (see FIG. 6).

When the compressor (21) is driven under the above conditions, the refrigerant is compressed by the compressor (21), thereby discharged therefrom in the form of high-temperature refrigerant having a supercritical pressure and then flows into the outdoor air heat exchanger (27). The outdoor air heat exchanger (27) is defrosted by heat release of the high-temperature refrigerant. During the defrosting, since the refrigerant is at supercritical pressure, its temperature decreases without condensation even if it releases heat. The refrigerant passes through the second expansion valve (26) without being reduced in pressure and then flows into the room air heat exchanger (25). At the room air heat exchanger (25), the refrigerant releases heat to room air and the heated room air is supplied in the form of warm air to the room.

Next, the refrigerant is reduced to a predetermined pressure by the first expansion valve (24) and then flows into the indoor radiant panel (23). At the indoor radiant panel (23), the refrigerant takes heat of the indoor radiant panel (23) itself to evaporate. In other words, the first expansion valve (24) is controlled to reduce the refrigerant pressure (controlled in terms of opening) so that the refrigerant can evaporate with heat from the indoor radiant panel (23). The outdoor air heat exchanger (27) is generally likely to be frosted during the heating operation and, therefore, the defrosting operation is often performed during the heating operation. Therefore, the indoor radiant panel (23) stores heat having taken from the refrigerant during the heating operation. Hence, during the defrosting operation, the refrigerant can surely be evaporated using heat stored in the indoor radiant panel (23). The refrigerant having evaporated in the indoor radiant panel (23) is compressed again by the compressor (21). The refrigerant repeats this circulation. In this manner, the outdoor air heat exchanger (27) is defrosted and, concurrently, the room is heated with warm air from the room air heat exchanger (25).

Now, a description is given of the state of refrigerant in the above-stated refrigeration cycle (supercritical cycle) during the defrosting operation with reference to the Mollier diagram shown in the broken lines in FIG. 5. The state of refrigerant repeatedly changes in order from Point A1 to Point B1, then to Point C1, then to Point D1, then to Point E1 and then back to Point A1.

Specifically, the refrigerant sucked into the compressor (21) to reach Point A1 is compressed to Point B1 by the compressor (21) to be high-temperature refrigerant at supercritical pressure. The refrigerant having reached Point B1 releases heat in the outdoor air heat exchanger (27) to reduce its temperature and thereby reach Point C1. The refrigerant having reached Point C1 further releases heat in the room air heat exchanger (25) to reduce its temperature and thereby reach Point D1. The refrigerant having reached Point D1 is reduced in pressure to Point E1 by the second expansion valve (26). The refrigerant having reached Point E1 is evaporated by taking heat from the indoor radiant panel (23) to reach Point A1 and is then sucked into the compressor (21) again. As seen from the above, during the defrosting operation in this embodiment, the indoor radiant panel (23) functions as an evaporator with the use of heat stored therein and the outdoor air heat exchanger (27) and the room air heat exchanger (25) function as gas coolers. Thus, since in the supercritical cycle the refrigerant has a wide high-temperature region, this provides a necessary amount of heat released from the refrigerant in the outdoor air heat exchanger (27) and the room air heat exchanger (25). Therefore, a sufficient room heating can be provided by warm air from the room air heat exchanger (25) while the outdoor air heat exchanger (27) is defrosted. Hence, there is no need to stop the heating operation in order to perform the defrosting operation unlike the conventional techniques, which prevents impairment of comfort in the room. Furthermore, since the refrigerant discharged from the compressor (21) has a higher temperature than in the subcritical cycle, the capacity to defrost the outdoor air heat exchanger (27) can be enhanced.

Effects of Embodiment

As described so far, according to this embodiment, the second expansion valve (26) is set to a fully-open position and the first expansion valve (24) is controlled to reduce the refrigerant pressure, so that during a defrosting operation in a cooling cycle the outdoor air heat exchanger (27) and the room air heat exchanger (25) can function as gas coolers and the indoor radiant panel (23) can function as an evaporator. Thus, the air conditioning system can provide room heating while defrosting the outdoor air heat exchanger (27). As a result, the comfort in the room can be prevented from being impaired even during the defrosting operation.

Furthermore, since the air conditioning system operates in a supercritical cycle using carbon dioxide as refrigerant, the refrigerant can have a wide high-temperature region. Therefore, during the defrosting operation, a sufficient amount of heat released from the refrigerant and needed for the defrosting of the outdoor air heat exchanger (27) and the room heating of the room air heat exchanger (25) can be obtained. Thus, the air conditioning system can surely provide defrosting and room heating. Since during the heating operation the radiant heat of the indoor radiant panel (23) can be increased, the amount of air from the room air heat exchanger (25) can be reduced accordingly, thereby reducing the sense of draft. As a result, the comfort in the room can be improved.

On the other hand, during the cooling operation, the room is cooled also by the radiative cooling of the indoor radiant panel (23). Therefore, the amount of cold air from the room air heat exchanger (25) can be reduced accordingly, thereby reducing the sense of draft.

Modifications of Embodiment

Next, a description is given of Modifications 1 and 2 of the above embodiment. Modifications 1 and 2 are different from the above embodiment in the configuration of the indoor unit (11).

Figure 9B:
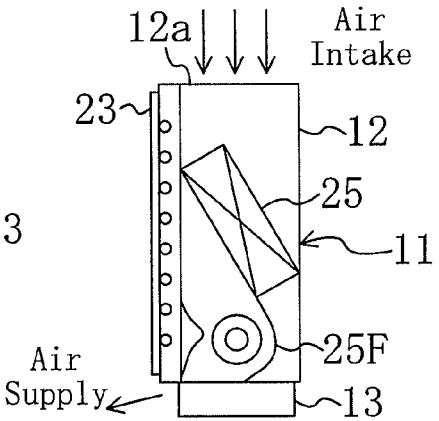
FIG. 9 shows the configuration of an indoor unit according to Modification 1, wherein 9A is a front view and 9B is a cross-sectional view as viewed from the right.
Figure 9A:
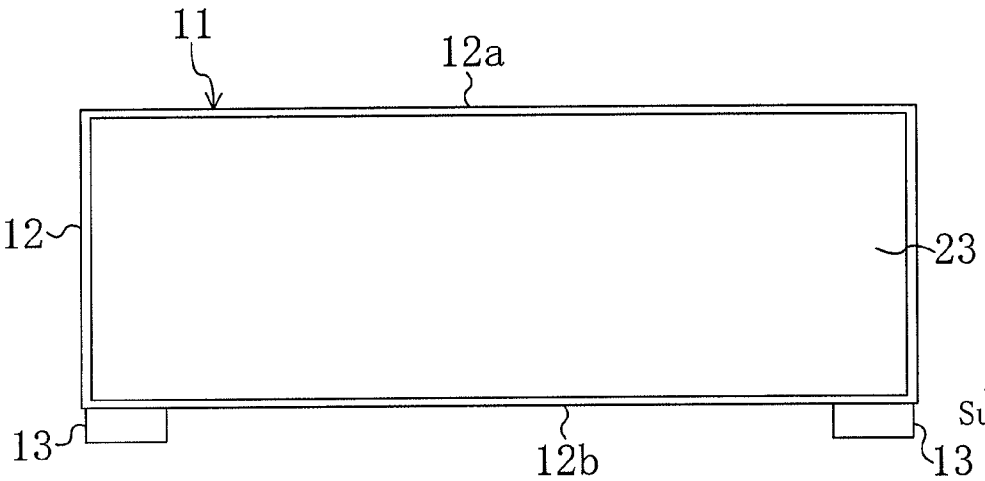

Modification 1 is, as shown in FIG. 9, different from the above embodiment in the arrangement of the inlet (12*a*) and the outlet (12*b*) of the casing (12). The inlet (12*a*) is formed in the top surface of the casing (12) to extend in the longitudinal direction, while the outlet (12*b*) is formed in the center of the bottom surface of the casing (12). The room air heat exchanger (25) is disposed with its top inclined towards the indoor radiant panel (23).

Figure 10B:
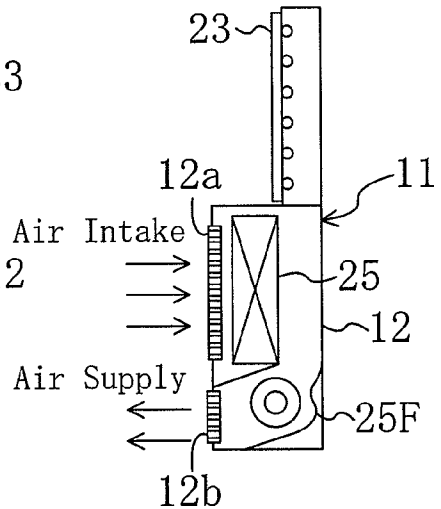
FIG. 10 shows the configuration of an indoor unit according to Modification 2, wherein 10A is a front view and 10B is a cross-sectional view as viewed from the right.
Figure 10A:
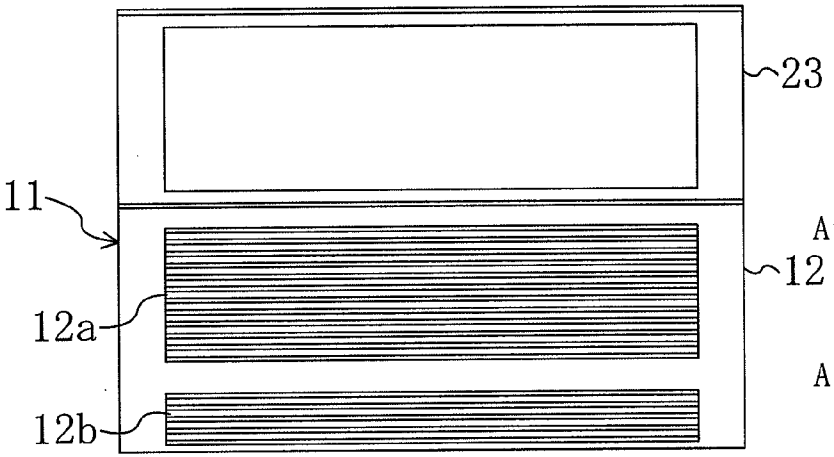

Modification 2 is, as shown in FIG. 10, different from the above embodiment in the arrangement of the indoor radiant panel (23), the inlet (12*a*) and the outlet (12*b*). The indoor radiant panel (23) is disposed on the top of the casing (12) towards the back side thereof to stand up. The radiant surface of the indoor radiant panel (23) is oriented to the front. The inlet (12*a*) and the outlet (12*b*) are formed in the front surface of the casing (12). The inlet (12*a*) is located in the upper half of the front surface of the casing (12) and formed horizontally to extend in the longitudinal direction. The outlet (12*b*) is located in the front surface of the casing (12) below the inlet (12*a*) and formed horizontally to extend in the longitudinal direction.

Other Embodiments

The above embodiment and modifications may have the following configurations. For example, although in the above embodiment and modifications the outdoor heat exchanger is an outdoor air heat exchanger (27) in which refrigerant exchanges heat with air, it is not limited to this and may constitute a heat exchanger in which refrigerant exchanges heat with any other heat transfer medium, such as water or brine.

In the above embodiment and modifications of the present invention, the bypass passage (28) may be dispensed with or the indoor radiant panel (23) may be configured separately from the room air heat exchanger (25).

Although in the above embodiment and modifications the air conditioning systems capable of performing a cooling operation are described, the present invention is also applicable to air conditioning systems capable of performing only a heating operation and a defrosting operation other than a cooling operation.

The above embodiments are merely preferred embodiments in nature and are not intended to limit the scope, applications and use of the invention.

INDUSTRIAL APPLICABILITY

As can be seen from the above, the present invention is useful as an air conditioning system that includes a refrigerant circuit including an indoor radiant panel and an indoor heat exchanger.

The invention claimed is:

1. An air conditioning system comprising: a refrigerant circuit in which a compressor, an indoor radiant heat exchanger, a first pressure reduction mechanism, a room air heat exchanger, a second pressure reduction mechanism and an outdoor heat exchanger are connected in this order and which operates in a vapor compression refrigeration cycle by reversibly circulating refrigerant therethrough; and an indoor fan for supplying room air to only the room air heat exchanger of the indoor radiant heat exchanger and the room air heat exchanger, wherein the air conditioning system is configured to perform a heating operation in which the second pressure reduction mechanism is controlled to reduce a refrigerant pressure so that in a heating cycle of the refrigerant circuit the refrigerant releases heat in the indoor radiant heat exchanger and the room air heat exchanger and takes heat in the outdoor heat exchanger to evaporate, and a defrosting operation in which the first pressure reduction mechanism is controlled to reduce the refrigerant pressure so that in a cooling cycle of the refrigerant circuit the refrigerant releases heat in the outdoor heat exchanger and the room air heat exchanger and takes heat stored during the heating operation in the indoor radiant heat exchanger to evaporate, and the outdoor heat exchanger frosted in the heating operation is defrosted.

2. The air conditioning system of claim 1, wherein the air conditioning system is configured to perform a cooling operation in which the second pressure reduction mechanism is controlled to reduce the refrigerant pressure so that in the cooling cycle of the refrigerant circuit the refrigerant releases heat in the outdoor heat exchanger and takes heat in the room air heat exchanger and the indoor radiant heat exchanger to evaporate.

3. The air conditioning system of claim 2, wherein the refrigerant circuit includes a bypass passage through which the refrigerant flows to bypass the indoor radiant heat exchanger and the first pressure reduction mechanism, and the bypass passage is provided with a shut-off valve.

4. The air conditioning system of claim 1, wherein the indoor radiant heat exchanger and the room air heat exchanger are provided in a single indoor unit, the indoor radiant heat exchanger is provided on a casing for the indoor unit so that a radiant surface thereof emitting radiant heat faces a room, and the room air heat exchanger is contained in the casing for the indoor unit.

5. The air conditioning system of claim 1, wherein the second pressure reduction mechanism is configured to avoid reduction of the refrigerant pressure so that in the cooling cycle of the refrigerant circuit the refrigerant releases heat in the outdoor heat exchanger and the room air heat exchanger and takes heat in the indoor radiant heat exchanger to evaporate.

6. The air conditioning system of claim 1, wherein the refrigerant is carbon dioxide.

* * * * *